United States Patent [19]

Diau

[11] Patent Number: 4,575,784

[45] Date of Patent: Mar. 11, 1986

[54] CHARGEABLE WORKING LIGHT

[75] Inventor: Golden Diau, Taipei, Taiwan

[73] Assignee: Michael Hung, Taipei, Taiwan

[21] Appl. No.: 684,492

[22] Filed: Dec. 21, 1984

[51] Int. Cl.[4] ..... F21L 7/00

[52] U.S. Cl. ..... 362/183; 362/191; 362/200; 362/199

[58] Field of Search ..... 362/191, 199, 200, 269, 362/190, 183

[56] References Cited

U.S. PATENT DOCUMENTS

| | | | |
|---|---|---|---|
| 1,699,927 | 1/1929 | Stearns | 362/199 |
| 3,393,312 | 7/1968 | Dahl | 362/183 |
| 3,435,206 | 3/1969 | Swanson | 362/183 |
| 3,787,678 | 1/1974 | Rainer | 362/183 |
| 3,825,740 | 7/1974 | Friedman | 362/183 |
| 3,904,920 | 9/1975 | Griffith | 362/183 |
| 4,317,162 | 2/1982 | Richards | 362/183 |
| 4,325,107 | 4/1982 | MacLeod | 362/183 |
| 4,357,648 | 11/1982 | Nelson | 362/183 |

*Primary Examiner*—Ronald B. Cox

*Attorney, Agent, or Firm*—Knobbe, Martens, Olson & Bear

[57] ABSTRACT

The chargeable working light of the present invention utilizes an electrical circuit to achieve the functions of charging a storage battery from a power source, and of alternatively supplying power to a lighting element from the power source and the battery simultaneously. In addition, the structure of the chargeable working light gives facilities for being adjusted to properly provide illumination from a desired place and direction.

4 Claims, 4 Drawing Figures

CHARGEABLE WORKING LIGHT

BACKGROUND OF THE INVENTION

The present invention is related to a chargeable working light, and more particularly to a working light for an automobile which does not use a dry battery, but is chargeable, and capable of providing sufficient illumination from a proper lighting angle.

When an automobile is out of order on the road, the driver usually has to use a working light to provide illumination for repairing. In general, there are several types of the conventional working lights such as following: The first type of the working light directly obtains power from a battery used in the automobile. Therefore, such a working light may easily causes the battery to become exhausted; the second type of the working light is chargeable, and capable of being detached from its charging seat for more convenient use, however, since such a working light lacks an adequate securing device, it can not be adjusted to the lighting angle thereof, therefore it can not effectively provide proper illumination; the third type of the working light is connected to the battery used in an automobile through a connection line. This working light not only has the disadvantages mentioned above, but also has the drawback that the working area is limited to the maximum length of the connection line.

A chargeable working light for an automobile in accordance with one preferred embodiment of the present invention intends to improve on the above-described disadvantages.

SUMMARY OF THE INVENTION

One object of the present invention is to provide a chargeable working light which utilizes an electric circuit to achieve the functions of charging a storage battery from a power source, and of alternatively supplying power to a lighting element from both the power source and the storage battery.

Another object of the present invention is to provide a chargeable working light with means for securing the working light in a proper place in order to adequately illuminate the object.

In accordance with the present invention, the chargeable working light comprises a body having a lighting element therein; a storage battery provided within the body and coupled to the lighting element; a charging circuit adapted to be connected to a power source, coupled to the storage battery; a supply circuit connected in parallel to the charging circuit, and connected in series to the lighting element; and a switch coupled between the charging circuit and the supply circuit for switching the charging circuit to charge the storage battery, and concurrently switching off the supply circuit from the lighting element in a first switching position thereof; and for switching the charging circuit and the supply circuit to concurrently supply power to the lighting element in a second switching position thereof.

In accordance with another aspect of the present invention, the chargeable working light further comprises means for movably securing the body to a desired place, pivotally connected on the body for a user to adjust the lighting angle of the lighting element.

BRIEF DESCRIPTION OF THE DRAWINGS

The present invention will be more fully understood from the following detailed description, taken in connection with the accompanying drawings which form a integral part of this application and in which.

DETAILED DESCRIPTION OF THE PREFERRED EMBODIMENT

Figure 1:
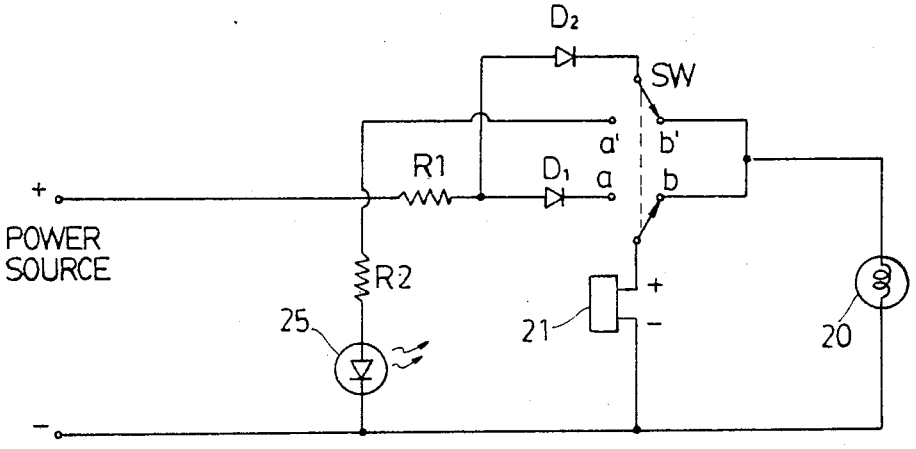
FIG. 1 is a schematic electrical diagram of a chargeable working light according to one preferred embodiment of the present invention.

Referring now to the drawings, it should be noted that a like member is designated with a like reference number. In FIG. 1, there is shown a schematic electrical diagram of a chargeable working light, a storage battery 21 is coupled to a lighting element 20 through a switch SW. A charging circuit consists of a resistor R1 and a charging diode D1 connected in series with each other, is adapted to be connected to a power source, and coupled to the storage battery 21 through the switch SW. A supply circuit consists of the resistor R1 and a diode D2, in which the diode D2 is connected in series to the lighting element 20 through the switch SW. An electrical circuit of a charging-stage indicator 24, particularly shown in FIG. 2, is made up of a indicating resistor R2 and a light-emitting diode 25 connected in series with each other, and is connected in series to the supply circuit through the switch SW.

The switch SW as shown is a two-pole switch, therefore when it is switched to the first switching position a—a', the power source will charge the storage battery 21 through the resistor R1 and the charging diode D1, and concurrently turns on the light-emitting diode 25 through the resistor R1, the diode D2, and the resistor R2 to indicate that the charging process is under way. When the switch SW is switched to the second switching position b—b' as shown in FIG. 1, the storage battery 21 will supply the power to the lighting element 20, and the power source will also supply power to the lighting element 20 through the resistor R1 and the diode D2. In this case, the light-emitting diode 25 is also turned off by the switch SW as shown in FIG. 1 to indicate that the illuminating process is under way. In the chargeable working light of the present invention, the power source and the storage battery 21 can simultaneously supply the power to the lighting element 20. Thus, the disadvantages which exists in the conventional working light, namely that power was provided from the automobile battery or a separate dry battery, has been improved on.

Figure 2:
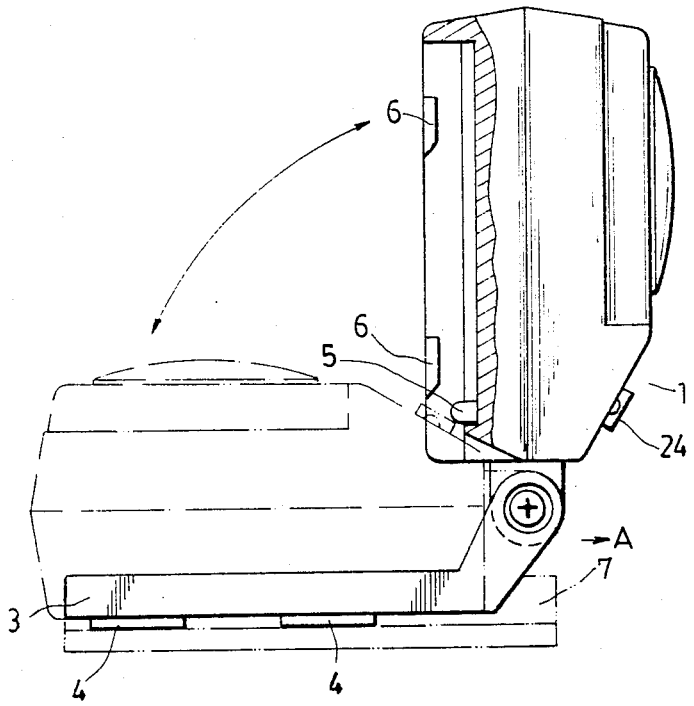
FIG. 2 is a side elevational view with a partial cross section of the chargeable working light of the present invention.
Figure 3:
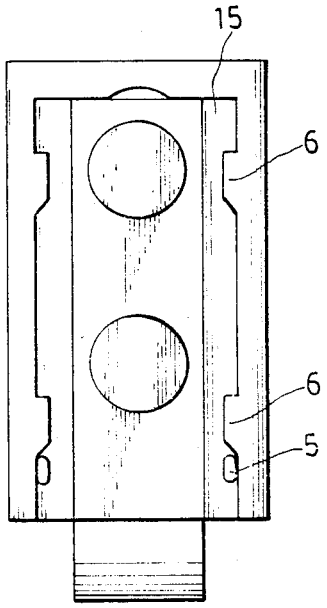
FIG. 3 is a rear elevational view of the chargeable working light with a securing means received in the rear concavity of a body.
Figure 4:
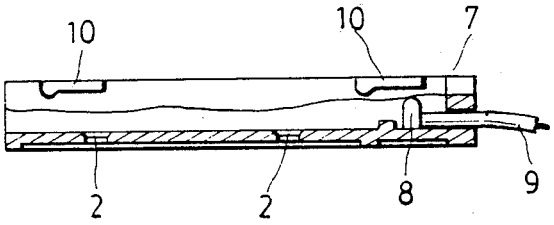
FIG. 4 is a side elevational view with a partial cross section of a charging seat.

Referring now to FIGS. 2 to 4, which show the outer structure of the chargeable working light according to one preferred embodiment of the present invention. In FIG. 2, a body 1 accommodates all the elements shown in FIG. 1 therein. A securing means 3 is provided with two magnets 4 thereon, and pivotally connects on the lower part of the body 1 for the body 1 capable of rotating in relation to the securing means 3. Thus, when the securing means 3 is secured on the metallic portion of the automobile, the body 1 can be adjusted to a proper angle to provide adequate illumination. When the securing means is received in a rear concavity 15 of the body 1 as shown in FIG. 2 (wherein the body 1 is shown by the phantom line) or FIG. 3, the body 1 and the securing means 3 can be engaged onto a charging seat 7, this will be further described hereinafter.

Referring to FIG. 3, the body 1 has four first projections 6 on the periphery of its rear surface, and two first conductive contacts 5 coupled to the charging circuit (not shown). Referring to FIG. 4, a charging seat 7 is shown with a cross section of the lower part. The charging seat 7 has four second projections 10 on its two sides (two of the second projections 10 are shown in FIG. 4), and two second conductive contacts 8 there in (one of the second conductive contacts 8 is shown in FIG. 4), which is connected to a power source, for example the battery used in an automobile, through the connection line 9. When the body 1 is slid into the charging seat 7 in the direction of the arrow A as shown in FIG. 2, the first projections 6 will be positioned under and engaged with the second projections 10, and the first conductive contacts 5 will also electrically contact with the second conductive contacts 8. Therefore, the body 1 and the securing means 3 is movably engaged on the charging seat 7, and the power source or the battery can supply the power to the charging/supply circuit through the second and the first conductive contacts 8 and 5. Since the movable engagement between the body 1 and the charging seat 7 can be easily achieved by a prior known technique, further description is unnecessary. Moreover, the charging seat 7 can be fastened onto any desired place on the automobile by two screws or nails screwing or nailing into two apertures 2 thereof.

In operation, if the place on which the charging seat 7 is fastened, can still provide adequate illumination, the body 1 can still be engaged on the charging seat 7, so that the power source and the storage battery 21 all supply power to the lighting element 20. If the place on which the charging seat 7 is fastened, cannot provide adequate illumination, the body 1 can be detached from the charging seat 7 to secure at another proper place by use of the magnets 4 of the securing means 3. In addition, the pivot connection between the body 1 and the securing means 3 gives facilities for the body 1 to be adjusted to a proper lighting angle in order to illuminate from the best direction to the working place.

It should be noted that in this preferred embodiment of the present invention, the securing means 3 utilizes the magnets 4 to secure itself and the body 1 because the main body of the automobile is made of metal. If the application of the chargeable working light of the present invention is not for use in the automobile, those who are ordinarily skilled in the art will understand that the magnets 4 of the securing means 3 also can be replaced by other devices. In addition, it also should be noted that the pivot connection is not limited to the type as shown in FIG. 2, the other types of connections can also be used, for example the socket joint, or the like.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modification and equivalent structures.

What I claim is:

1. A chargeable working light comprising:

a body having a lighting element therein;

a storage battery provided within said body and coupled to said lighting element;

a charging circuit adapted to be connected to a power source, coupled to said storage battery;

a supply circuit connected in parallel to said charging circuit, and connected in series to said lighting element;

a switch coupled between said charging circuit and said supply circuit for switching said charging circuit to charge said storage battery, and concurrently switching off said supply circuit from said lighting element in a first switching position thereof, and for switching said charging circuit and said supply circuit to concurrently supply the power to said lighting element in a second switching position thereof;

means for movably securing said body on a desired place, said means being pivotally connected with said body for a user to adjust the lighting angle of said lighting element;

said securing means having at least one magnet thereon;

a charging seat connected to said power source, said seat being movably engaged with said body for supplying the power to said charging circuit, and said seat being adapted to be fastened onto a proper place; and said supply circuit consists of a resistor and a diode connected in series with each other.

2. A chargeable working light as claimed in claim 1, wherein said charging circuit consists of said resistor and a charging diode connected in series with each other.

3. A chargeable working light as claimed in claim 2, further comprising a charging-state indicator for being switched to provide a visible indication of the current charging process of said storage battery by said switch in its first switching position.

4. A chargeable working light as claimed in claim 3, wherein said charging-state indicator includes a indicating resistor connected in series to said supply circuit, and a light-emitting diode connected in series to said indicating resistor.

* * * * *